US008152321B2

(12) United States Patent
Lindholm

(10) Patent No.: US 8,152,321 B2
(45) Date of Patent: Apr. 10, 2012

(54) ILLUMINATION APPARATUS FOR A DRINK HOLDER

(76) Inventor: Peter J. Lindholm, Albuquerque, NM (US)

( * ) Notice: Subject to any disclaimer, the term of this patent is extended or adjusted under 35 U.S.C. 154(b) by 0 days.

(21) Appl. No.: 13/084,329

(22) Filed: Apr. 11, 2011

(65) Prior Publication Data

US 2012/0002400 A1 Jan. 5, 2012

Related U.S. Application Data

(60) Provisional application No. 61/325,621, filed on Apr. 19, 2010.

(51) Int. Cl.
*F21V 33/00* (2006.01)

(52) U.S. Cl. ..... 362/101; 362/96

(58) Field of Classification Search ..... 362/96, 362/154, 155, 101
See application file for complete search history.

(56) References Cited

U.S. PATENT DOCUMENTS 4,886,183 A * 12/1989 Fleming ..... 220/739
5,990,790 A 11/1999 Lusareta
6,086,216 A * 7/2000 Goldfarb ..... 362/101
6,270,233 B1 * 8/2001 Holland ..... 362/154
7,232,237 B2 6/2007 Bigger
2003/0076672 A1 * 4/2003 Head ..... 362/101
2003/0081408 A1 * 5/2003 Tai ..... 362/101
2003/0090891 A1 * 5/2003 Wang et al. ..... 362/101
2003/0090892 A1 * 5/2003 Su ..... 362/101
2004/0212987 A1 * 10/2004 Lu ..... 362/101
2005/0036301 A1 * 2/2005 Haines ..... 362/101
2005/0047114 A1 * 3/2005 Harrell et al. ..... 362/101
2005/0063176 A1 * 3/2005 Sutton ..... 362/101
2005/0073832 A1 * 4/2005 Shilton et al. ..... 362/101
2006/0186297 A1 * 8/2006 Lore, Sr. ..... 248/311.2

* cited by examiner

*Primary Examiner* — Julie Shallenberger
(74) *Attorney, Agent, or Firm* — McAuley and Associates

(57) ABSTRACT

An illumination apparatus for a drink holder that includes a base portion having a planar top surface attachable to a bottom surface of the drink holder, a lighting device disposed at an exterior bottom surface of the base portion, to supply light in a downward direction away from the drink holder, and a circuit enclosed by the base portion at a predetermined distance from the planar top surface of the base portion. The circuit includes a power supply unit to supply power for operation of the lighting device, a light driving unit electrically connected with the power supply unit and the lighting device, to regulate power supplied to the lighting device, and a switch device configured to switch the illumination apparatus between an on-state and an off-state.

20 Claims, 14 Drawing Sheets

ILLUMINATION APPARATUS FOR A DRINK HOLDER

CROSS-REFERENCE

The present invention claims priority to Provisional Application Ser. No. 61/325,621 filed Apr. 19, 2010, entitled "Can C LED", which is hereby incorporated by reference.

BACKGROUND

The present invention relates to an illumination apparatus for a drink holder, and more specifically, to an illumination apparatus for a drink holder, which supplies light for a user in a direction away from the drink holder to serve as a flashlight.

Some activities such as equipment repair, barbequing, fishing, camping, hiking, walking dogs, playing, or reading may require the use of a lighting device such as a flashlight or lamp, when performed during evening hours, to enhance visibility for the user. The user may also have a beverage while participating in these activities. Drink holders such as drink insulators are commonly used today for housing drink containers therein. Although these items are used separately, a user may commonly use them at the same time while performing the above-mentioned activities which may be challenging for the user.

Therefore, it is desirable to provide an illumination apparatus for a drink holder which allows a user to have a beverage close by while also operating the illumination apparatus when desired.

SUMMARY

According to an embodiment of the present invention, an illumination apparatus for a drink holder is provided. The illumination apparatus includes a base portion having a planar top surface attachable to a bottom surface of the drink holder, a lighting device disposed at an exterior bottom surface of the base portion and configured to supply light in a downward direction away from the drink holder, and a circuit enclosed by the base portion at a predetermined distance from the planar top surface of the base portion. The circuit includes a power supply unit configured to supply power for operation of the lighting device, a light driving unit electrically connected with the power supply unit and the lighting device, and configured to regulate power supplied to the lighting device, and a switch device configured to switch the illumination apparatus between an on-state and an off-state.

The illumination apparatus of the present invention may be incorporated into a drink holder to allow you to carry your beverage and an illumination apparatus in the same hand, for convenience to a user.

According to another embodiment of the present invention, a drink holder is provided. The drink holder includes a body portion configured to house a drink container therein. The body portion includes sidewall portions having a height less than a height of the drink container to be housed within the drink holder, a base portion integrally combined with the sidewall portions and having a planar top surface, and a lighting device disposed at an exterior bottom surface of the base portion and configured to supply light in a downward direction away from the drink holder. The body portion further includes a circuit enclosed by the base portion at a predetermined distance from the planar top surface of the base portion and including a power supply unit configured to supply power for operation of the lighting device, a light driving unit electrically connected with the power supply unit and the lighting device, and configured to regulate power supplied to the lighting device, and a switch device configured to switch the illumination apparatus between an on-state and an off-state.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other, features, and advantages of the invention are apparent from the following detailed description taken in conjunction with the accompanying drawings in which:

DETAILED DESCRIPTION

Figure 1:
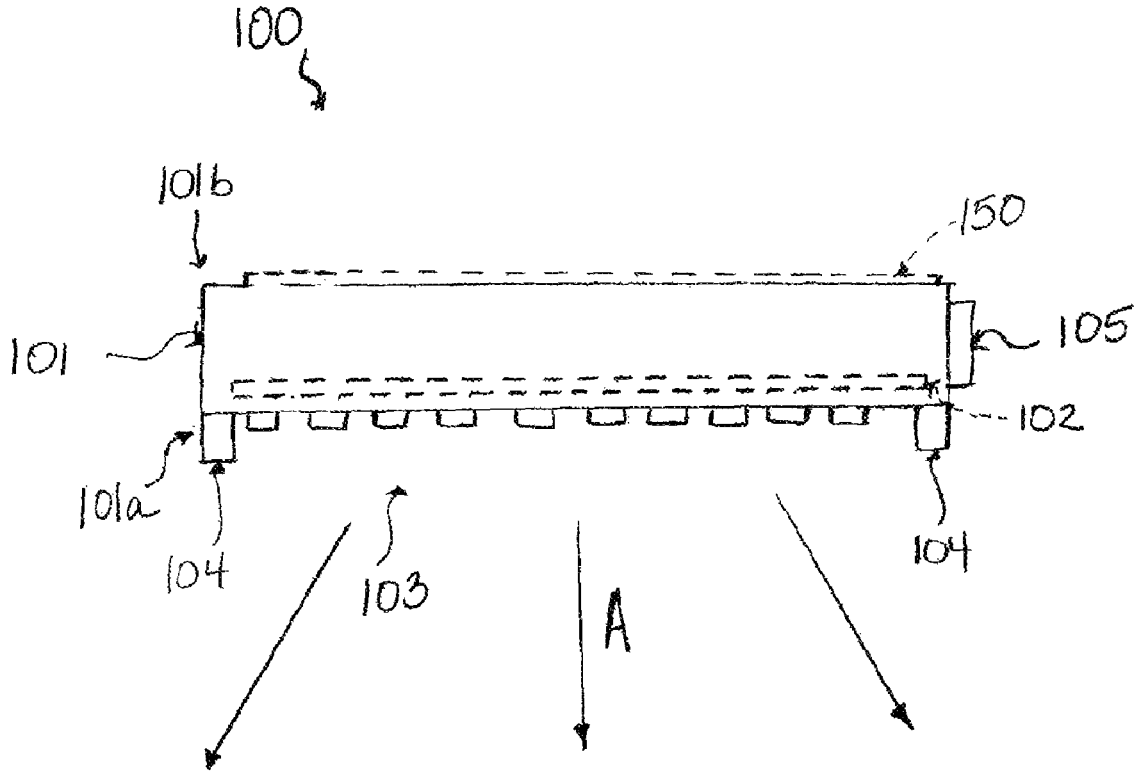
FIG. 1 is a diagram illustrating an illumination apparatus that can be implemented within embodiments of the present invention.

With reference now to FIG. 1, an illumination apparatus is provided for a drink holder (e.g., a Koozie®) according to an embodiment of the present invention is shown. The illumination apparatus of the present invention is not limited to being used with a drink holder and may be applied to other uses, for example, the illumination apparatus used as a hood light, trunk light, or within tool box or any other suitable use. As shown in FIG. 1, the illumination apparatus 100 includes a base portion 101 attachable to a bottom surface of the drink holder (300 shown in FIG. 8B, for example). According to an embodiment of the present invention, the base portion 101 includes a bottom portion 101*a* and a planar top surface 101*b* corresponding to the planar bottom surface of the existing drink holder and side portions. The base portion 101 may be formed of various materials such as polyurethanes, polyurethane foam open cell, polyurethane closed cell, molded polyurethane foam elastomers, EVA/Ethylen Vinyl Acetate, neoprene/polychloroprene, polyethylene, PVC, vinyl nitrile, latex, sponge rubber, cork, thermoplastics, thermoplastic elastomers rubber, elastomeric gels, viscoelastic foam, thermosets, closed cell sponge rubber and plastic foam, open cell sponge rubber and plastic foam, or any other suitable material for the purpose set forth herein.

According to an embodiment of the present invention, the base portion 101 includes a circuit board e.g., a printed circuit board (PCB) 102 to house the main components of the illumination apparatus 100. The circuit board 102 is enclosed by the base portion 101 at a predetermined distance from the planar top surface 101*b* such that the circuit board 102 is not exposed to an exterior of the base portion 101. A lighting device 103 is connected to the circuit board 102 and extends from an exterior bottom surface 101*a* of the base portion 101 and is configured to supply light in a downward direction away from the drink holder (as depicted by the arrows A). Details regarding these main components will be discussed below with reference to FIG. 2.

Figure 3A:
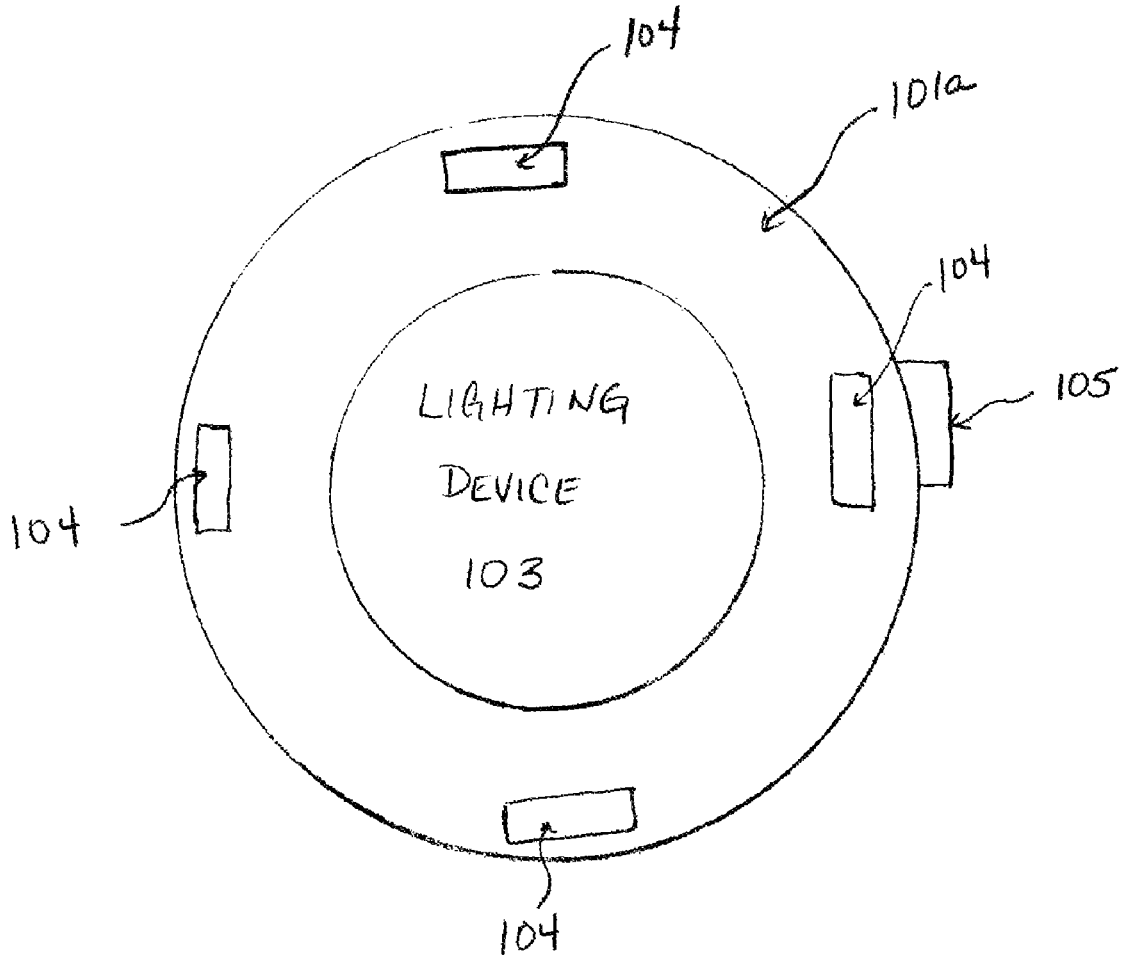
FIG. 3A is a diagram illustrating the lighting device shown in FIG. 2 that can be implemented within embodiments of the present invention.

According to an embodiment of the present invention, referring to FIG. 1, the base portion 101*a* may include a plurality of feet portions 104 extended from the exterior bottom surface 101*a*, to place the base portion 101 in an upright position on an external surface (not shown) such as a table. The plurality of feet portions 104 may be disposed along a perimeter of the exterior bottom surface 101*a* of the base portion 101 (as shown in FIG. 3A, for example). These feet portions 104 may include section portions or bump portions, for example. The feet portions 104 may be disposed in any space on the bottom surface 101*a* where an LED 103, 103*a* is not located. The feet portions 104 allow the illumination apparatus 100 and the drink holder connected thereto, to be elevated above surface level so that the light illuminating from the illumination apparatus 100 in the direction A (as depicted in FIG. 1, for example) will illuminate on the surface surrounding and beneath the drink holder.

Figure 2:
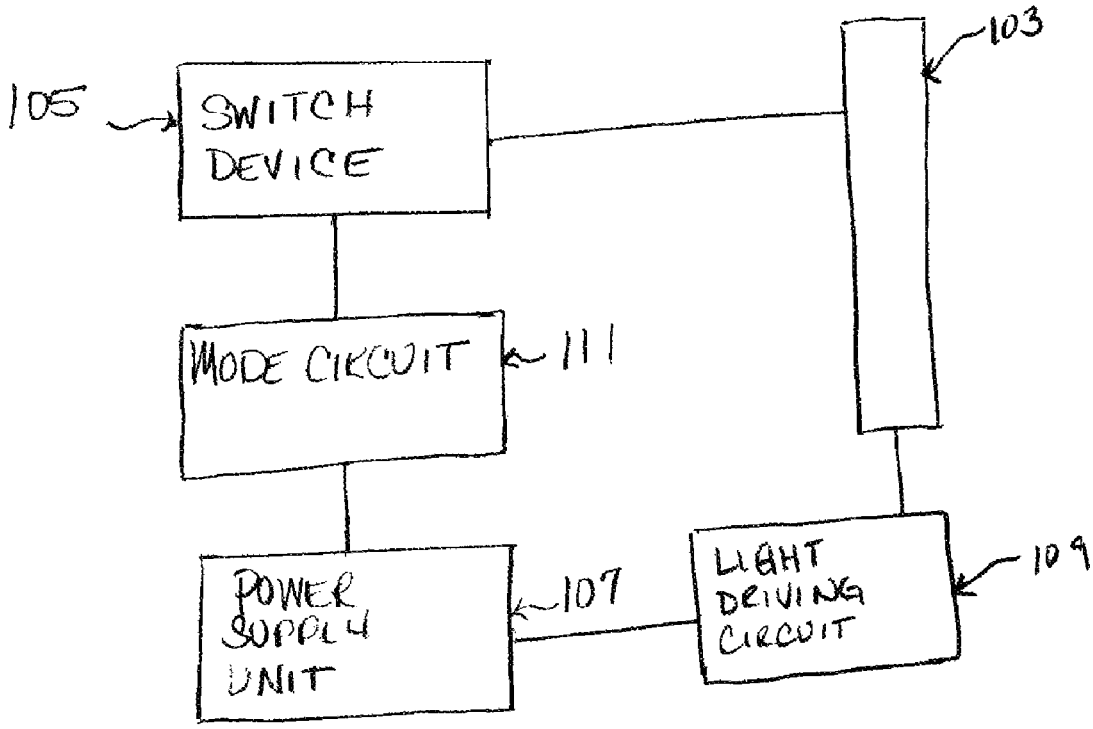
FIG. 2 is a block diagram illustrating a base portion of the illumination apparatus that can be implemented within embodiments of the present invention.

FIG. 2 is a block diagram illustrating a base portion of the illumination apparatus that can be implemented within embodiments of the present invention. As shown in FIG. 2, some of the main components of the illumination apparatus 100 may include a switch device 105, a power supply unit 107, a light driving circuit 109 and a mode circuit 111. The power supply unit 107 is configured to supply power for operation of the lighting device 103. Details regarding the power supply unit 107 will be discussed later with reference to FIGS. 4 and 5. As shown in FIG. 2, the light driving unit 109 is electrically connected with the power supply unit 107 and the lighting device 103, and regulates the power supplied to the lighting device 103.

According to an embodiment of the present invention, the switch device 105 is connected between the power supply unit 107 and the lighting device 103 and is used to turn the illumination apparatus 100 (shown in FIG. 1) on and off. The mode circuit 111 may be provided and used to allow a user to perform operation of the illumination apparatus 101 in a plurality of modes. For example, the plurality of modes may include at least one of bright, medium, low, fast flashing, slow flashing, and automatic shut-off. The switch device 105 is provided to the user as a push button, sliding switch or toggle switch, for example, or any other suitable switch device for the purpose set forth herein.

Details regarding the lighting device 103 will now be described below with reference to FIGS. 3A through 3C. According to an embodiment of the present invention, the lighting device 103 may be a single light source or a plurality of light sources. As shown in FIG. 3A, the lighting device 103 is a single light source (e.g., a light emitting diode) disposed at an exterior bottom surface 101*a* of the base portion 101.

Figure 3B:
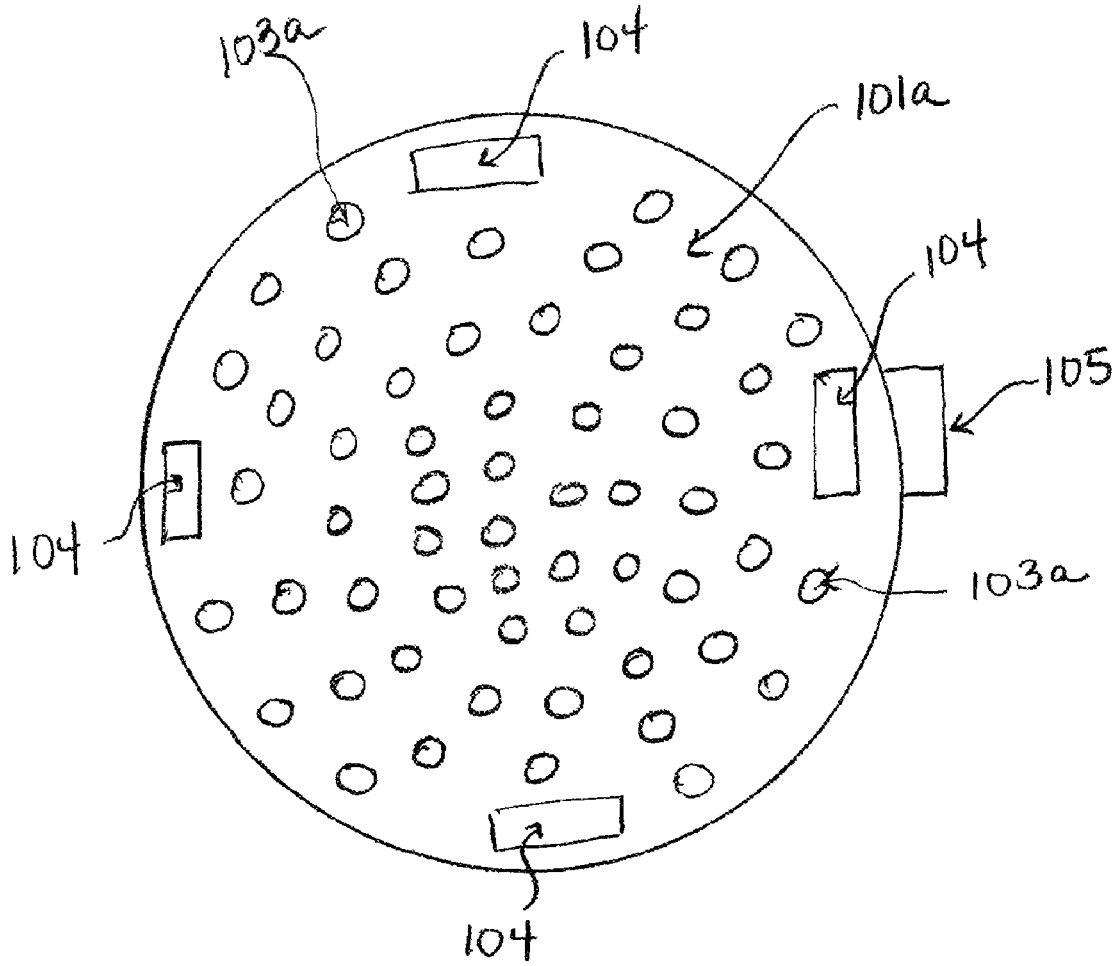
FIG. 3B is a diagram illustrating a plurality of LEDs of the lighting device that can be implemented within alternative embodiments of the present invention.

FIG. 3B is a diagram illustrating a plurality of LEDs of the lighting device that can be implemented within alternative embodiments of the present invention. As shown in FIG. 3B, the lighting device 103 comprises a plurality of light emitting diodes (LEDs) 103*a* configured to supply light in a predetermined direction. The present invention is not limited to the use of any particular number of LEDs 103*a* or a predetermined position of the LEDs or connection (parallel or series) between the LEDs 103*a* and may vary accordingly. Also, the LEDs 103*a* may be of various different colors and sizes. For example, some of the LEDs 103*a* may be red, while other of the LEDs may be blue. Further the LEDs 103*a* along the perimeter of the base portion 101*a* may be larger than the LEDs 103*a* in a center region of the bottom surface 101*a*.

Figure 3C:
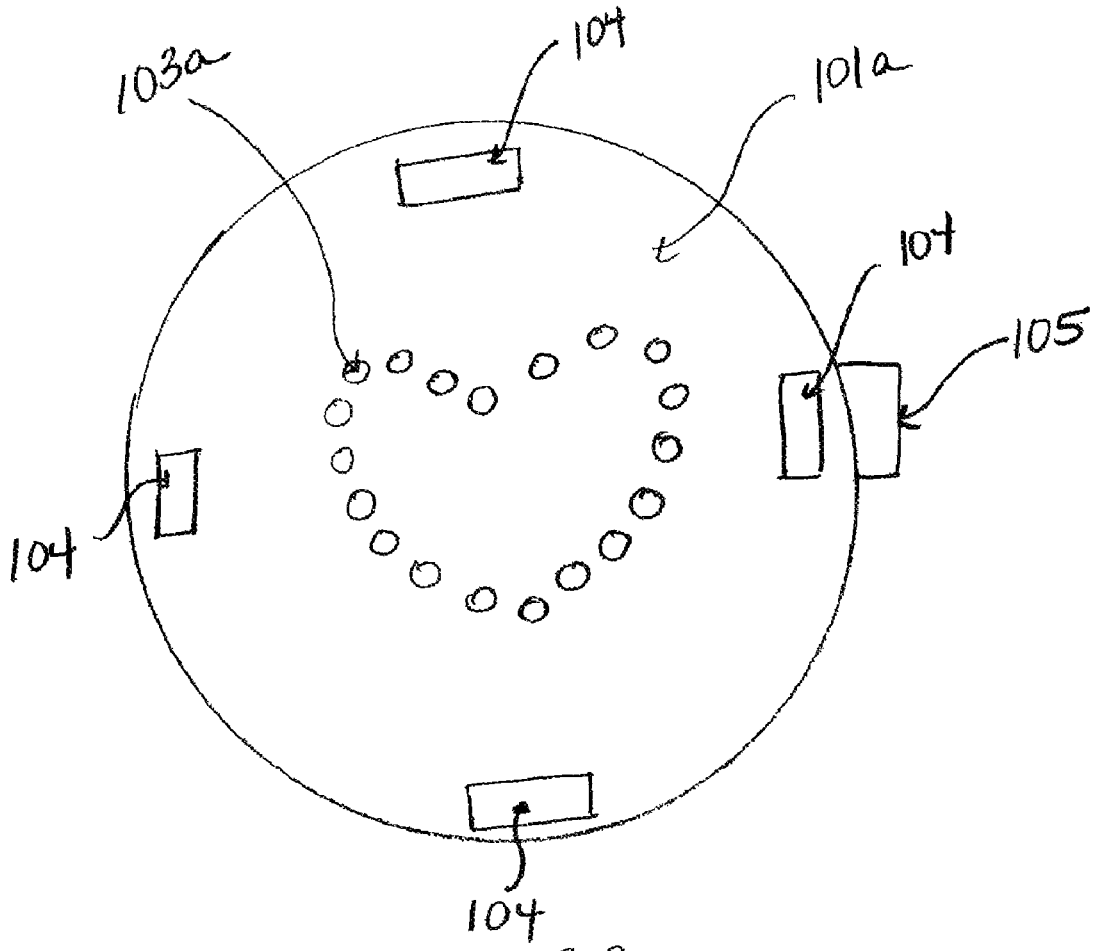
FIG. 3C is a diagram illustrating a predetermined position of the LEDs of the lighting device that can be implemented within alternative embodiments of the present invention.

FIG. 3C is a diagram illustrating a predetermined position of the LEDs of the lighting device that can be implemented within alternative embodiments of the present invention. As shown in FIG. 3C, the LEDs 103*a* are disposed in a predetermined position to supply light in a specified shape corresponding to the predetermined position. For example, in FIG. 3C, the specified shape is that of a heart. The specified shape may be an animal, face, number or any desirable shape. The present invention is not limited to any particular shape formed by the arrangement of the LEDs, and may vary accordingly. According to an embodiment of the present invention, the illumination apparatus 100 (shown FIG. 1) may be formed to allow users to configure their own lighting design by providing receptacles or plugins, for example, at the circuit board 102 for the user to input LEDs 103*a* where desired.

Details regarding the power supply unit 107 will now be discussed below with reference to FIGS. 4 and 5.

Figure 4:
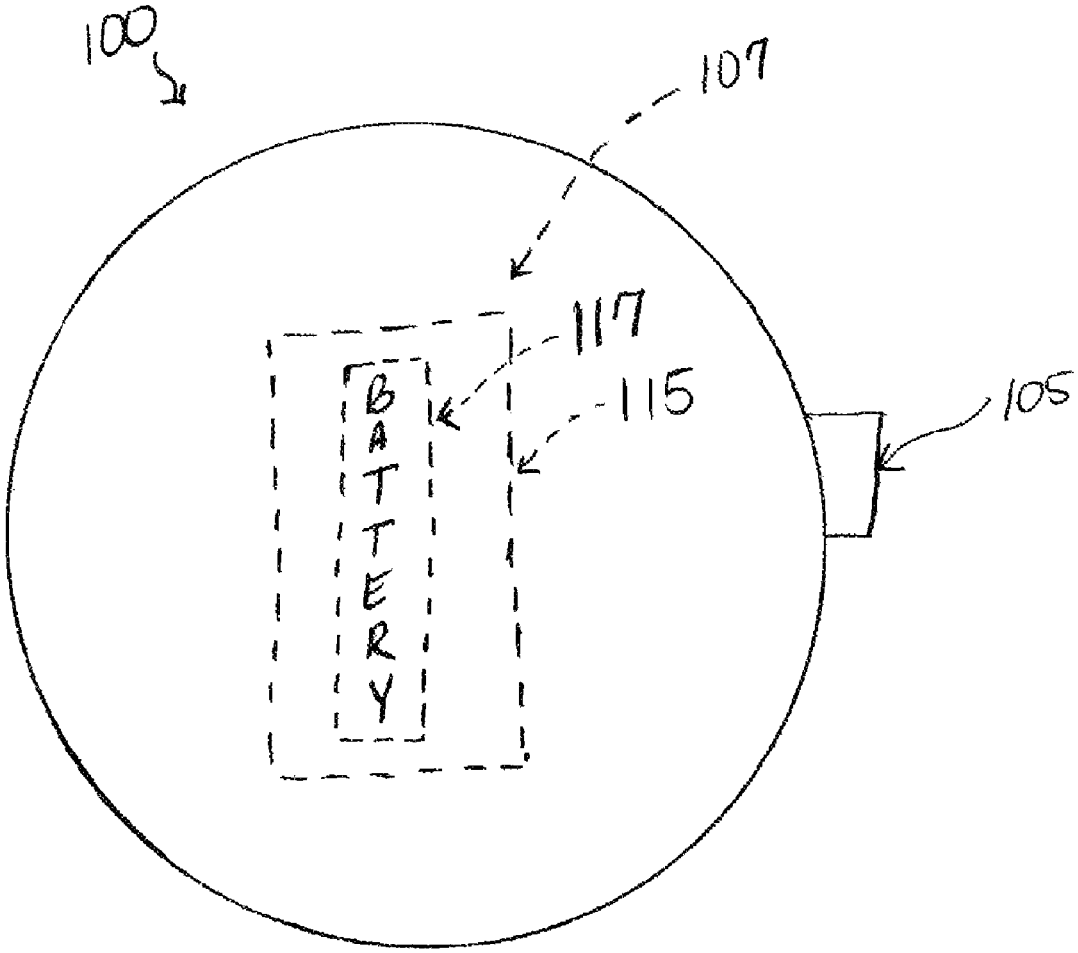
FIG. 4 is a diagram illustrating a power supply unit shown in FIG. 2 that can be implemented within embodiments of the present invention.

FIG. 4 is a diagram illustrating a power supply unit shown in FIG. 2 that can be implemented within embodiments of the present invention. Referring back to FIG. 1, the illumination apparatus 100 may be battery-operated, for example. Thus, as shown in FIG. 4, the power supply unit 107 may include a battery case unit 115 formed within the base portion 101, and at least one battery 117 disposed within the battery case unit 115 to provide power for the lighting device 103 (as depicted in FIG. 3A), or the lighting devices 103*a* (as depicted in FIG. 3B, for example). The batteries 117 may be replaceable or non-replaceable however the present invention is not limited hereto; a rechargeable battery pack may also be utilized as discussed below.

Figure 5:
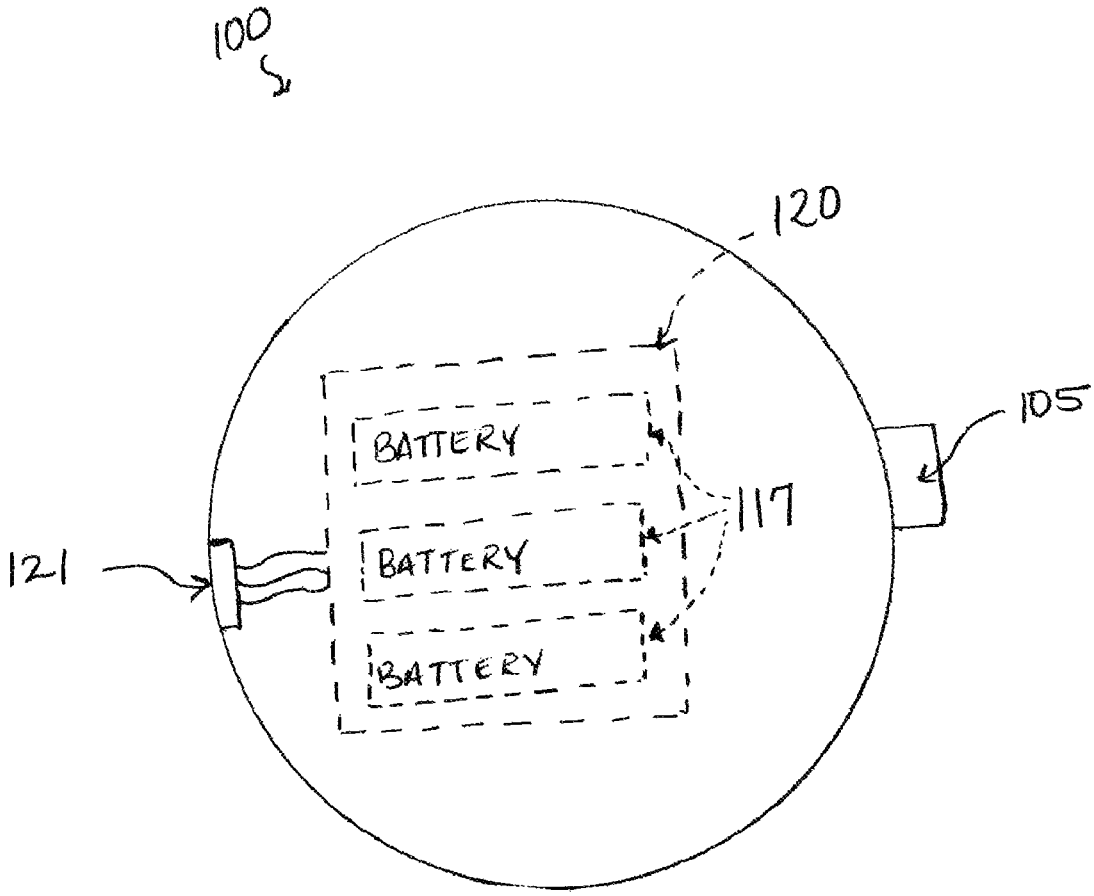
FIG. 5 is a diagram illustrating a power supply unit of the illumination apparatus that can be implemented within alternative embodiments of the present invention.

FIG. 5 is a diagram illustrating a power supply unit of the illumination apparatus that can be implemented within alternative embodiments of the present invention. The power supply unit 107 may include a rechargeable battery pack 120 having a plurality of batteries 117 and a connector 121 may be provided at an edge surface of the base portion 101 to facilitate the recharging operation of the rechargeable battery pack 120. The present invention is not limited to any particular type of power supply unit and may vary accordingly.

Referring back to FIG. 1, the illumination apparatus 100 is attached to a drink holder (not shown) using an attaching means 150 to secure the planar top surface 101*b* of the base portion 101 to a bottom exterior surface of an existing drink holder (not shown). According to an embodiment of the present invention, the attaching means 150 may be at least one of a double-sided adhesive material or a Velcro® material, for example. According to an embodiment of the present invention, any type of connection means may be used to connect the illumination apparatus of the present invention to an existing drink holder.

According to another embodiment of the present invention, an air channel 112 may also be formed in the base portion 101 to release air therethrough. Details regarding the air channel 112 will now be discussed below with reference to FIGS. 6A, 6B, 7A and 7B.

Figure 6A:
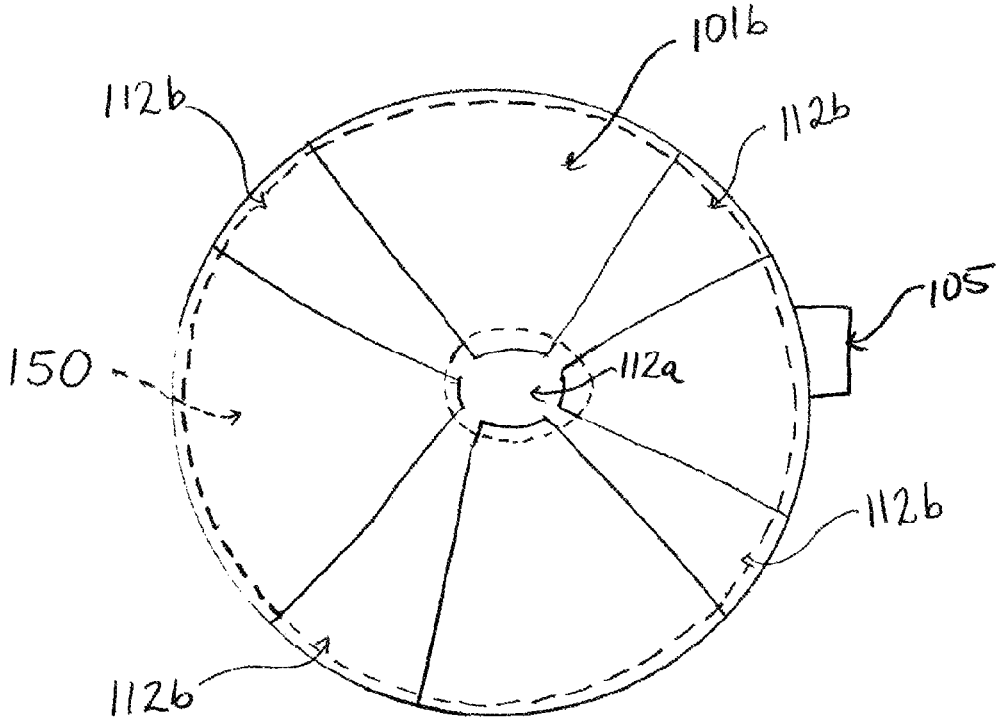
FIGS. 6A and 6B are schematic diagrams respectively illustrating a top view and a side view of an air channel that can be implemented within embodiments of the present invention.
Figure 6B:
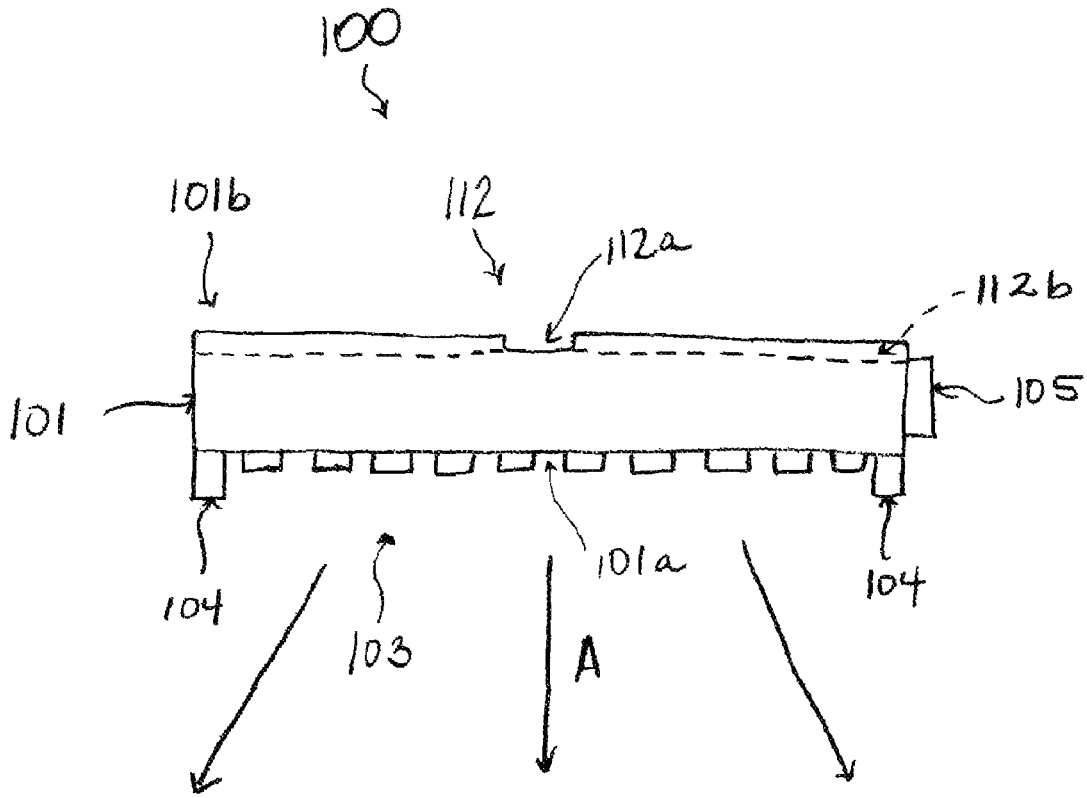
Figure 7A:
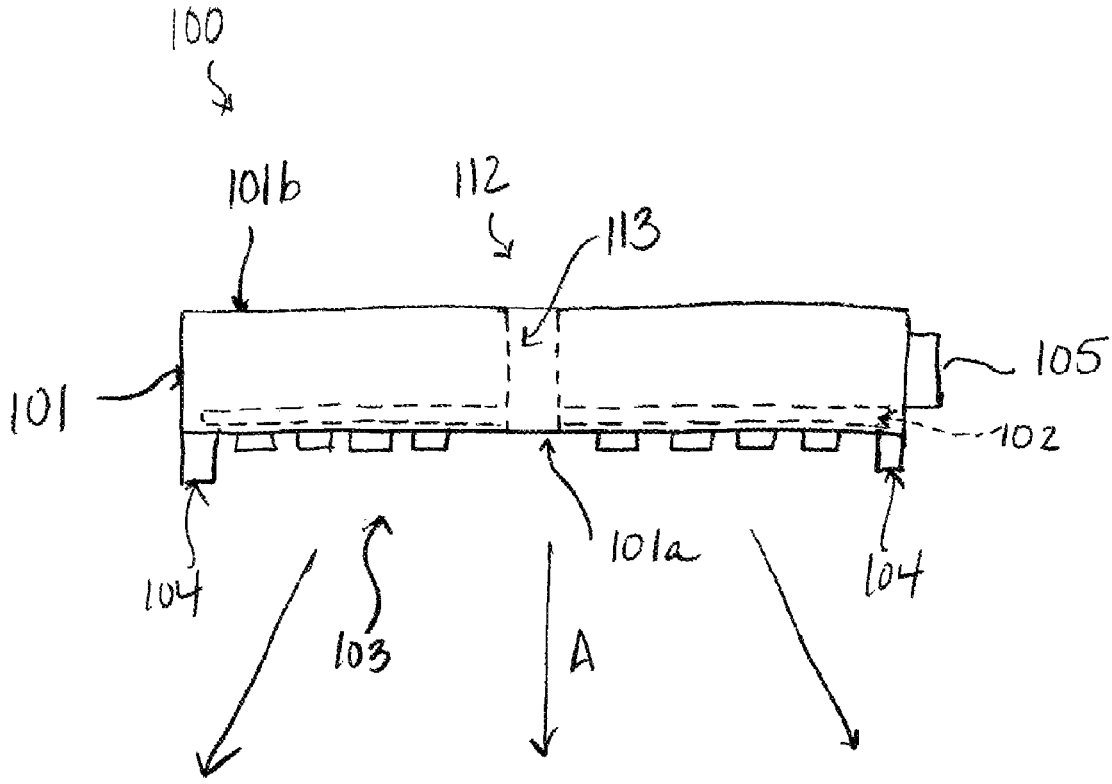
FIGS. 7A and 7B are schematic diagrams illustrating an air channel that can be implemented within alternative embodiments of the present invention.
Figure 7B:
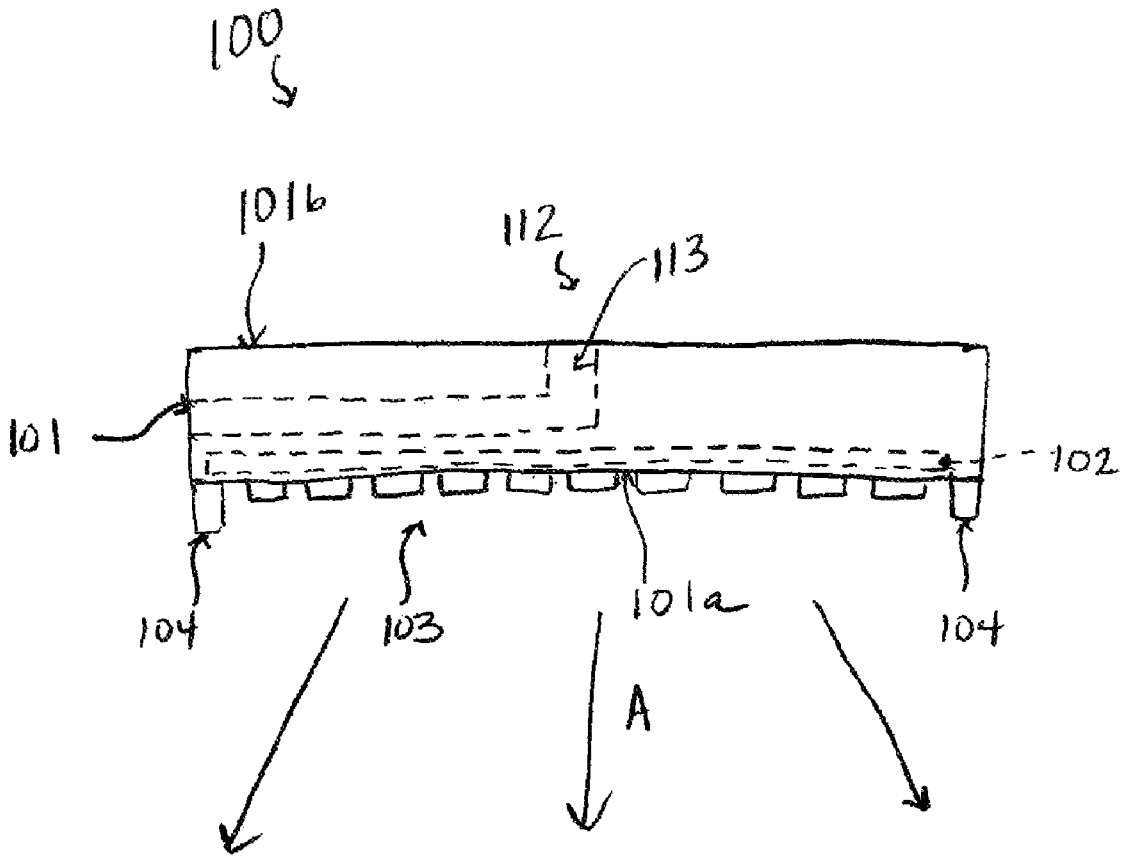

When a beverage container is fitted into a drink holder, air needs to escape out of the bottom of the drink holder due to the tight fit between the beverage container and the drink holder. On the other hand, when the beverage container is being removed from the drink holder, air is introduced back in to the drink holder to easily remove the beverage container from the drink holder. FIGS. 6A and 6B are schematic diagrams respectively illustrating a top view and a side view of an air channel that can be implemented within embodiments of the present invention. As shown in FIG. 6A, the air channel 112 includes a depressed portion 112*a* at a center region of the top surface 101*b* of the base portion 101, and a plurality of indented canal portions 112*b* radiating outward from the depressed portion 112*a*. According to an embodiment of the present invention, the depressed portion 112*a* may not include an adhesive material 150 thereon however as shown in FIG. 6A, all or a portion of the indented canal portions 112*b* may be covered with the adhesive material 150 such that any air may be removed within the canal portion 112*b* beneath the adhesive material 150 covering the same. A conventional drink holder typically includes a hole portion along a bottom surface thereof for releasing air. Thus, when a drink holder is connected to the illumination apparatus 100, the air may be dispersed along the line of connection there between. In this embodiment of the present invention, the attaching means 150 will be disposed along the portions of the top surface 101*b* which does not include the indented canal portions 112*b*. The present invention is not limited to any particular number of depressed portions 112*a* or indented canal portions 112*b* and may vary accordingly. The present invention is not limited to any particular type of air channel and may vary accordingly. FIGS. 7A and 7B are schematic diagrams illustrating an air channel that can be implemented within alternative embodiments of the present invention. As shown in FIGS. 7A and 7B, the air channel 112 may include at least one canal portion 113 extending through the base portion 101 to release air out of the bottom thereof or out of a side surface thereof as shown in FIG. 7B. The canal portion 113 is formed such that it circumvents the circuit board 102 to not interfere with the components thereof.

Figure 8A:
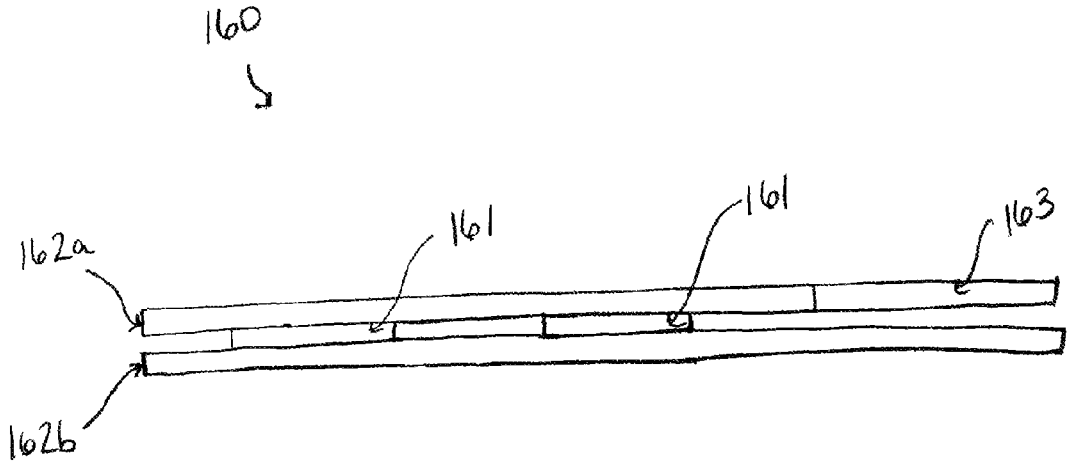
FIGS. 8A and 8B are schematic diagrams illustrating a securing mechanism that can be implemented within one embodiment of the present invention.
Figure 8B:
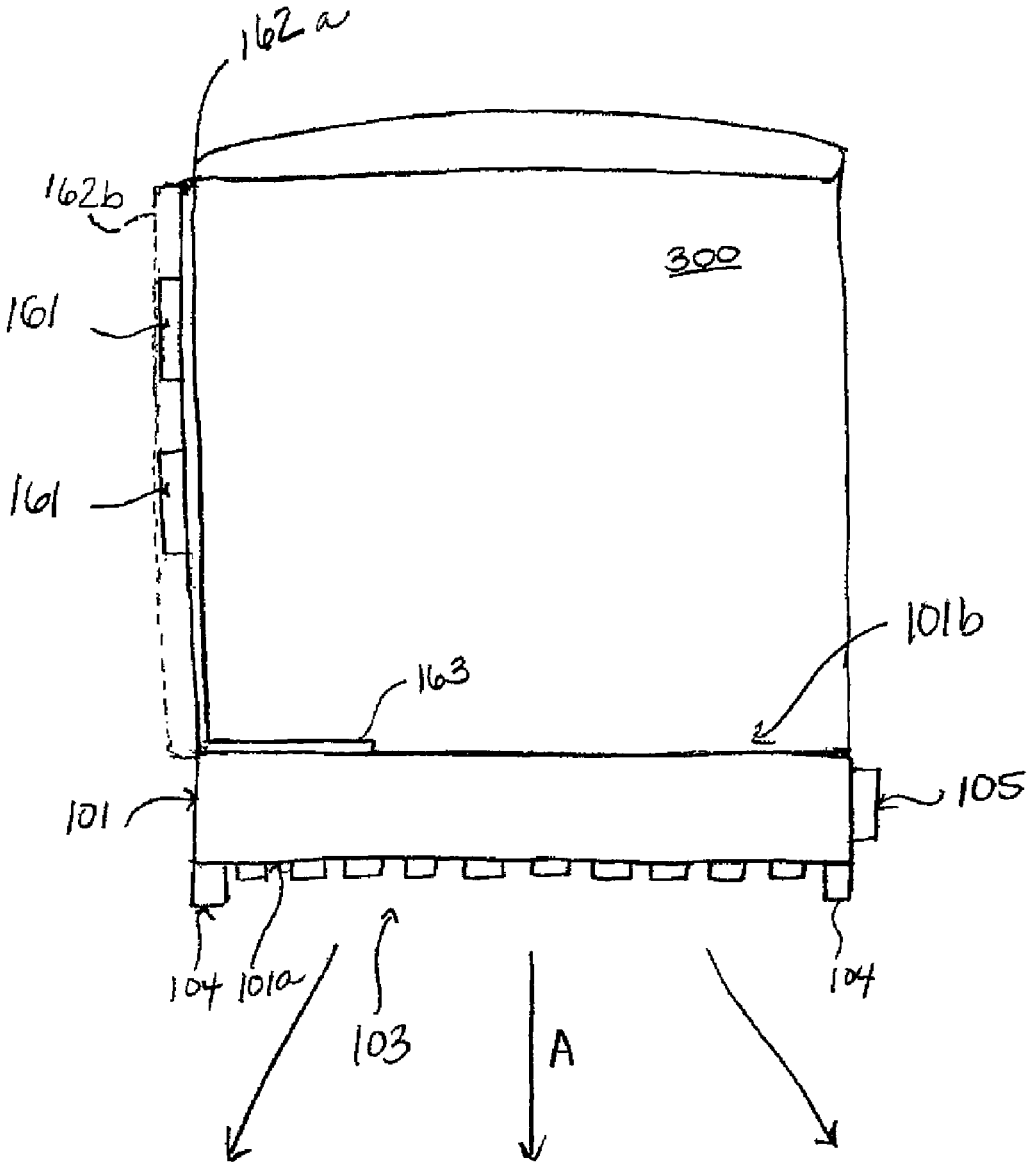

According to another embodiment of the present invention, a securing mechanism may be provided to secure the illumination apparatus and drink holder to an external surface not shown. The securing mechanism may include a plurality of magnets, suction cups, or a belt clip mechanism, for example. As shown in FIGS. 8A and 8B, a securing mechanism according to one embodiment of the present invention is provided. The securing mechanism 160 includes at least one securing portion (e.g., a plurality of magnets 161 or other type of securing portion) sandwiched between two layer portions 162*a* and 162*b*. The first and second layer portions 162*a* and 162*b* may be formed of the same or different materials. According to one embodiment of the present invention, the first layer portion 162*a* is formed of a double-sided adhesive, for example, for securing the magnets 161 to the side surface of an existing drink holder 300. The first layer portion 162*a* includes a flexible end portion 163 for securing to the top surface 101*b* of the base portion 101 of the illumination apparatus 101. According to an embodiment of the present invention, the second layer portion 162*b* may be formed of a single-sided adhesive, cloth material or rubber material and assists with securing the magnets 161 in place while being attached to the side surface of the drink holder 300. As shown in FIG. 8B, when implemented, the first layer portion 162*a* is secured along the side surface of the existing drink holder 300 such that the magnets 161 are attachable to the external surface.

Figure 9:
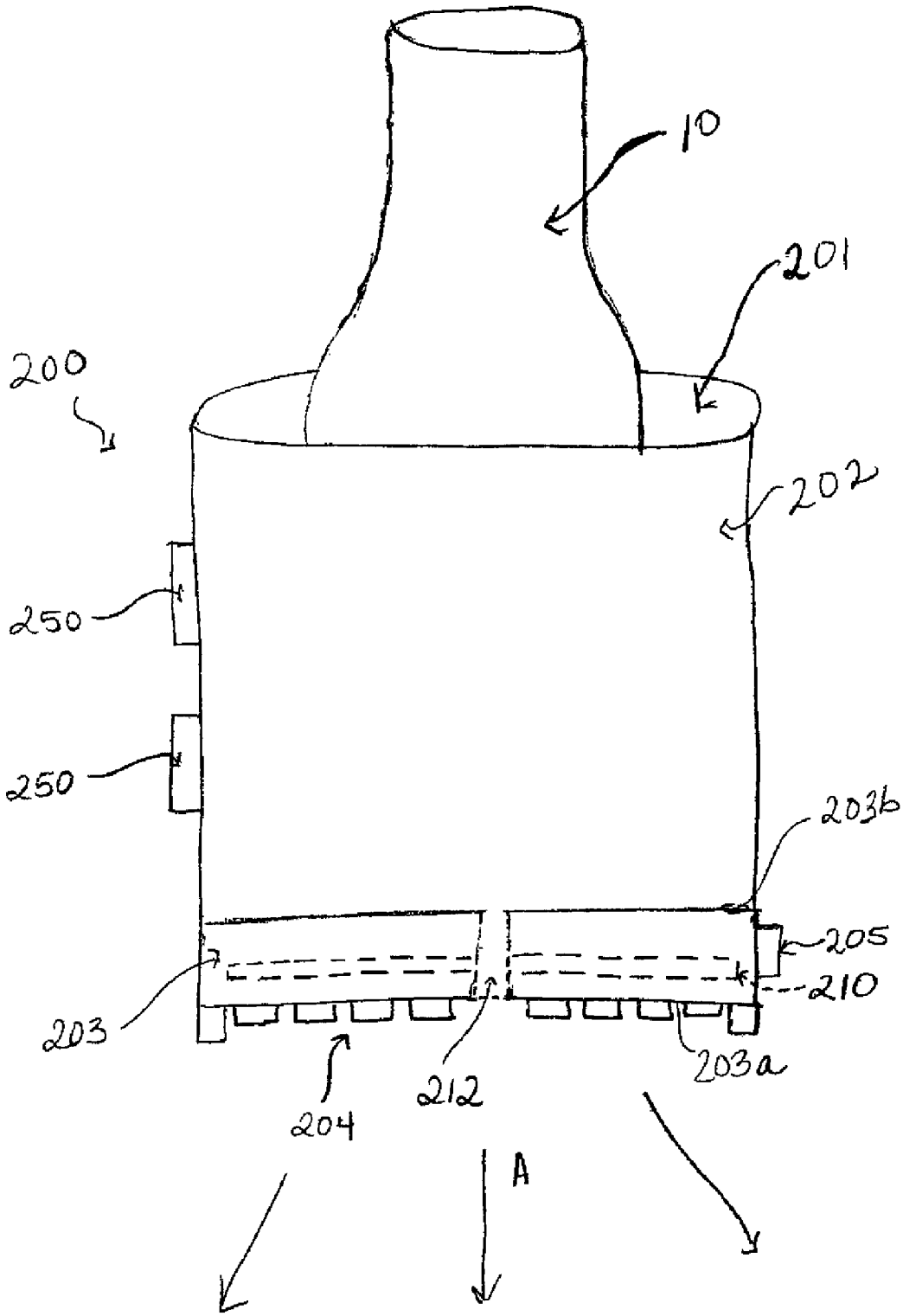
FIG. 9 is a diagram of a drink holder that can be implemented within embodiments of the present invention.

According to another embodiment of the present invention, a drink holder may be provided. FIG. 9 is a diagram illustrating a drink holder that can be implemented within embodiments of the present invention. As shown in FIG. 9, the drink holder 200 includes a body portion 201 configured to house a drink container 10 therein. The body portion 201 includes sidewall portions 202 and a base portion 203 integrally combined together. According to an embodiment of the present invention, the base portion 203 includes a bottom portion 203*a* and a planar top surface 203*b*. The drink holder 200 may be an insulated drink container. Further, the drink holder 200 may be formed of any shape or size. For example, it may be in a shape of a football, a golf ball or a pumpkin.

According to an embodiment of the present invention, the sidewall portions 202 are of a height less than a height of the drink container 10.

Further shown in FIG. 9, the lighting device 204 is disposed at an exterior bottom surface of the base portion 203 and configured to supply light in a downward direction away from the drink holder 200 (as depicted by arrows A). The base portion 203 has the same components stored therein as the base portion 101 shown in FIGS. 1 through 5; therefore a detailed description thereof is being omitted.

The drink holder 200 further includes a switch device 205 for operating the lighting device 204 and a circuit board 210 housing the main components of the base portion 203 therein. The circuit board 210 is enclosed by the base portion 203 at a predetermined distance from the planar top surface 203*b* such that the circuit board 210 is not exposed to an exterior of the base portion 203. An air channel 212 similar to the air channel 112 shown in FIG. 6A, 6B, 7A or 7B, for example, is also provided to release air therethrough.

According to an embodiment of the present invention, the drink holder 200 also includes a securing mechanism 250 to secure the drink holder 200 to an external surface (not shown). The securing mechanism 250 may be at least one securing portion (e.g., a plurality of magnets, suction cups, a belt clip or other type of securing portion) disposed on the sidewall portions 202 to secure the drink holder 200 to an external surface (not shown).

Embodiments of the present invention, provide an illumination apparatus for a drink holder to allow a user to carry a beverage within the drink holder while also using the illumination apparatus to supply light to increase visibility as desired by the user. Therefore, providing an added benefit when participating in activities such as camping, hiking, barbecuing, and auto repair.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one ore more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. An illumination apparatus for a drink holder, comprising:

a base portion having a planar top surface attachable to a bottom surface of the drink holder;

a lighting device disposed at an exterior bottom surface of the base portion and configured to supply light in a downward direction away from the drink holder; and a circuit enclosed by the base portion at a predetermined distance from the planar top surface of the base portion and comprising:

a power supply unit configured to supply power for operation of the lighting device, a light driving unit electrically connected with the power supply unit and the lighting device, and configured to regulate power supplied to the lighting device, and a switch device configured to switch the illumination apparatus between an on-state and an off-state wherein the base portion comprises a plurality of feet portions extended from the exterior bottom surface thereof, to place the base portion in an upright position on a support surface, wherein the plurality of feet portions comprise section portions or bump portions circumferentially located at predetermined distances apart to elevate the illumination apparatus above the support surface such that light passes between the feet portions when the drink holder is positioned on the support surface.

2. The illumination apparatus of claim 1, wherein the lighting device comprises a plurality of light emitting diodes configured to supply light in a predetermined direction.

3. The illumination apparatus of claim 2, wherein the light emitting diodes are disposed in a predetermined position to supply light in a specified shape corresponding to the predetermined position.

4. The illumination apparatus of claim 1, wherein the power supply unit comprises a battery case unit formed within the base portion; and at least one battery disposed within the battery case unit to provide power for the lighting device.

5. The illumination apparatus of claim 4, wherein the at least one battery is a rechargeable battery and a connector is disposed at an edge surface of the base portion and connected to the rechargeable battery to facilitate the recharging operation via an external recharging device.

6. The illumination apparatus of claim 1, wherein the circuit further comprising a mode circuit configured to perform operation of the illumination apparatus in a plurality Of modes wherein the plurality of modes comprises at least one of bright, medium, low, fast flashing, slow flashing, and automatic shut-off.

7. The illumination apparatus of claim 1, further comprising an air channel formed in the base portion to release air therethrough.

8. An illumination apparatus for a drink holder, comprising:

a base portion having a planar top surface attachable to a bottom surface of the drink holder;

a lighting device disposed at an exterior bottom surface of the base portion and configured to supply light in a downward direction away from the drink holder; and a circuit enclosed by the base portion at a predetermined distance from the planar to surface of the base portion and comprising:

a power supply unit configured to supply power for operation of the lighting device, a light driving unit electrically connected with the power supply unit and the lighting device, and configured to regulate power supplied to the lighting device, and a switch device configured to switch the illumination apparatus between an on-state and an off-state;

an air channel formed in the base portion to release air therethrough wherein the air channel comprises at least one canal portion extending through the base portion to release air out of the exterior bottom surface thereof or out of a side surface thereof and the at least one canal portion is formed to circumvent the circuit.

9. The illumination apparatus of claim 7, wherein the air channel comprises:

a depressed portion at a center region of the planar top surface of the base portion; and a plurality of indented canal portions radiating outward from the depressed portion such that air released from within the drink holder is removed via the depressed portion and the indented the canal portions to an outside.

10. The illumination apparatus of claim 1, further comprising an attaching means configured to attach the planar top surface of the base portion to a bottom exterior surface of the drink holder, wherein the attaching means comprises at least one of a double-sided adhesive material or a Velcro material.

11. The illumination apparatus of claim 1, further comprising:

a securing mechanism comprising at least one securing portion; and a first layer portion formed of an adhesive material and having a flexible end portion to secure to the planar top surface of the base portion, and a second layer portion, wherein the at least one securing portion is sandwiched between the first and second layer portions, such that the first layer portion is configured to be secured along a side surface of a drink holder such that the at least one securing portion is attachable to an external surface.

12. A drink holder comprising:

a body portion configured to house a drink container therein, and comprising:

sidewall portions having a height less than a height of the drink container to be housed within the drink holder;

a base portion integrally combined with the sidewall portions and having a planar top surface to dispose the drink container thereon;

a lighting device disposed at an exterior bottom surface of the base portion and configured to supply light in a downward direction away from the drink holder; and a circuit enclosed by the base portion at a predetermined distance from the planar top surface and comprising:

a power supply unit configured to supply power for operation of the lighting device, a light driving unit electrically connected with the power supply unit and the lighting device, and configured to regulate power supplied to the lighting device, and a switch device configured to switch the lighting device between an on-state and an off-state;

wherein the base portion comprises a plurality of feet portions extended from the exterior bottom surface thereof, to place the base portion in an upright position on a support surface, wherein the plurality of feet portions comprise section portions or bump portions circumferentially located at predetermined distances apart to elevate the illumination apparatus above the support surface such that light passes between the feet portions when the drink holder is positioned on the support surface.

13. The drink holder of claim 12, wherein the lighting device comprises a plurality of light emitting diodes configured to supply light in a predetermined direction.

14. The drink holder of claim 13, wherein the light emitting diodes are disposed in a predetermined position to supply light in a specified shape corresponding to the predetermined position.

15. The drink holder of claim 12, wherein the power supply unit comprises a battery case unit formed within the base portion, and at least one battery disposed within the battery case unit to provide power for the lighting device.

16. The drink holder of claim 15, wherein the at least one battery is a rechargeable battery and a connector is disposed at an edge surface of the base portion and connected to the rechargeable battery to facilitate the recharging operation via an external recharging device.

17. The drink holder of claim 12, wherein the circuit further comprising a mode circuit configured to perform operation of the lighting device in a plurality of modes wherein the plurality of modes comprises at least one of bright, medium, low, fast flashing, slow flashing, and automatic shut-off.

18. The drink holder of claim 12, further comprising:

an air channel formed in the base portion to release air therethrough and comprising:

at least one canal portion extending through the base portion to release air out of the exterior bottom surface thereof or out of a side surface thereof and the at least one canal portion is formed to circumvent the circuit; or a depressed portion at a center region of the planar top surface of the base portion, and a plurality of indented canal portions radiating outward from the depressed portion such that air released from within the drink holder is removed via the depressed portion and the indented the canal portions to an outside.

19. The drink holder of claim 12, further comprising:

a securing mechanism configured to secure the drink holder to an external surface wherein the securing mechanism comprises at least one securing portion disposed on the sidewalls portions.

20. The illumination apparatus of claim 11 wherein the at least one securing portion is a magnet.

* * * * *